US009022545B2

(12) United States Patent
Kondo et al.

(10) Patent No.: US 9,022,545 B2
(45) Date of Patent: May 5, 2015

(54) PRINTING APPARATUS FOR IRRADIATING UV LIGHT ON INK EJECTED ON MEDIUM AND PRINTING METHOD FOR IRRADIATING UV LIGHT ON INK EJECTED ON MEDIUM

(71) Applicant: Seiko Epson Corporation, Tokyo (JP)

(72) Inventors: Takamitsu Kondo, Nagano (JP); Toru Takahashi, Nagano (JP); Hiroshi Wada, Nagano (JP); Kazuyoshi Tanase, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/778,377

(22) Filed: Feb. 27, 2013

(65) Prior Publication Data

US 2013/0235135 A1 Sep. 12, 2013

(30) Foreign Application Priority Data

Mar. 8, 2012 (JP) ..... 2012-051965
Mar. 8, 2012 (JP) ..... 2012-051966

(51) Int. Cl.
*B41J 2/01* (2006.01)
*B41J 11/00* (2006.01)

(52) U.S. Cl.
CPC ..... *B41J 11/002* (2013.01)

(58) Field of Classification Search
CPC ..... B41J 11/002
USPC ..... 347/43, 102, 16, 51; 118/642
See application file for complete search history.

(56) References Cited

U.S. PATENT DOCUMENTS

| | | | | |
|---|---|---|---|---|
| 2003/0184632 | A1* | 10/2003 | Suzuki et al. | 347/102 |
| 2005/0157067 | A1* | 7/2005 | Hoshino | 347/43 |
| 2007/0206083 | A1* | 9/2007 | Hoshino | 347/102 |
| 2010/0182378 | A1* | 7/2010 | Mitsuzawa | 347/51 |
| 2011/0074857 | A1* | 3/2011 | Mitsuzawa | 347/16 |
| 2011/0242243 | A1* | 10/2011 | Miyabayashi | 347/102 |
| 2011/0290179 | A1* | 12/2011 | Stowell et al. | 118/642 |
| 2012/0194598 | A1* | 8/2012 | Fujisawa et al. | 347/16 |

FOREIGN PATENT DOCUMENTS

JP 2005-254560 A 9/2005

* cited by examiner

*Primary Examiner* — Julian Huffman
*Assistant Examiner* — Carlos A Martinez
(74) *Attorney, Agent, or Firm* — Global IP Counselors, LLP

(57) ABSTRACT

A printing apparatus having a head unit that ejects a yellow UV curable-type ink onto a medium, an irradiating section that irradiates the UV light, and a controller that works as follows: when the first mode is set, control is carried out so that, after the UV light with the first energy is irradiated on the UV curable-type ink ejected onto each unit area of the medium, the UV light with the second energy higher than the first energy is irradiated; when the second mode is set for printing an image with a glossiness higher than that of the image printed according to the first mode, control is carried out so that the UV light with an energy higher than that of the first energy is irradiated on the UV curable-type ink ejected on unit area of the medium.

3 Claims, 11 Drawing Sheets

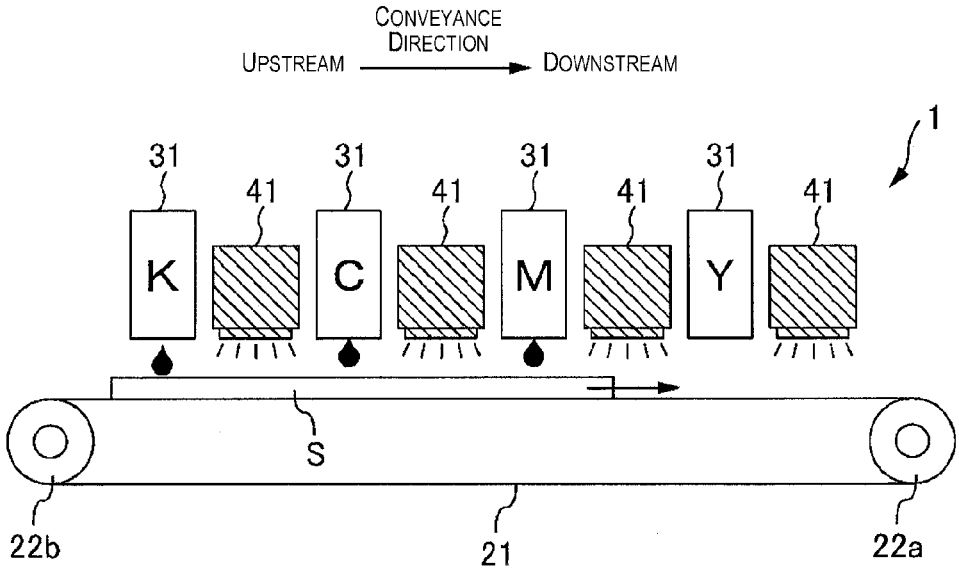
Fig. 2
Fig. 3A
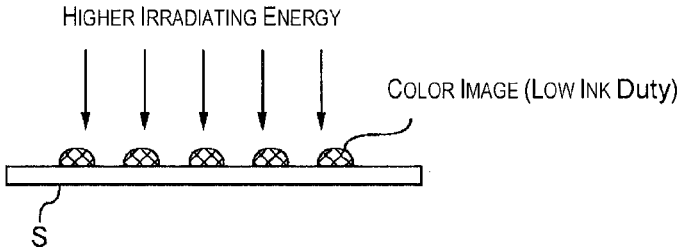
Fig. 3B
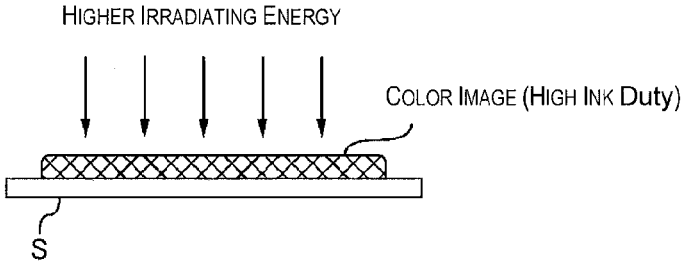
Fig. 3C
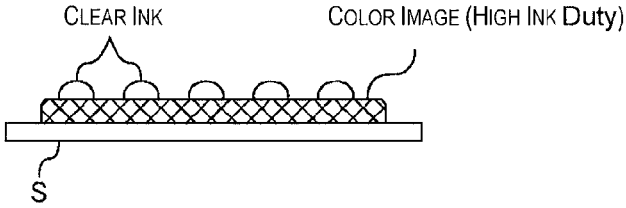

(GLOSSY IMAGE)

(MATTE IMAGE)

(GLOSSY IMAGE)

(MATTE IMAGE)

(GLOSSY IMAGE)

(MATTE IMAGE)

(MATTE IMAGE)

(MATTE IMAGE)

(GLOSSY IMAGE)

(MATTE IMAGE)

PRINTING APPARATUS FOR IRRADIATING UV LIGHT ON INK EJECTED ON MEDIUM AND PRINTING METHOD FOR IRRADIATING UV LIGHT ON INK EJECTED ON MEDIUM

CROSS-REFERENCE TO RELATED APPLICATIONS

This application claims priority to Japanese Patent Application No. 2012-051965 filed on Mar. 8, 2012 and Japanese Patent Application No. 2012-051966 filed on Mar. 8, 2012. The entire disclosure of Japanese Patent Application Nos. 2012-051965 and 2012-051966 is hereby incorporated herein by reference.

BACKGROUND

1. Technical Field

The present invention relates to a printing apparatus and a printing method.

2. Background Technology

An example of the printing apparatus is the inkjet printer (hereinafter to be referred to as the printer) that ejects ink droplets from a nozzle arranged on a head towards a paper sheet or another medium so that an image is printed on the medium. People have proposed various types of the printers, such as the type using a UV curable-type ink that cures under the irradiation of a UV light and the type using an LED element as the irradiating light source for the UV light (for example, see: Patent Document 1). For this type of printer, it is also possible to print the image on a medium made of plastic or metal or the like without an ink receiving layer.

Japanese Laid-open Patent Publication No. 2005-254560 (Patent Document 1) is an example of the related art.

SUMMARY

Problems to be Solved by the Invention

When a color image is printed with a high ink duty, that is with a high ink ejecting rate for unit area, the surface of the image becomes flat, so that it is impossible to print a matte image with a low glossiness. On the other hand, even for a color image printed with a high ink duty, if the clear ink droplets are ejected on the color image sparingly, the surface of the image can be made to be concavo-convex, and it is thus possible to print a matte image. However, the clear ink droplets are prone to be separated from the color image, so that the scratch resistance cannot be guaranteed.

In consideration of the problem, the purpose of the invention is to provide a method to print the matte image with high scratch resistance.

Means Used to Solve the Above-Mentioned Problems

In order to solve the problem, the invention provides a printing apparatus having (A) a head unit that ejects a yellow UV curable-type ink onto a medium, (B) an irradiating section that irradiates the UV light, and (C) a controller that works as follows: when the first mode is set, control is carried out so that, after the UV light with the first energy is irradiated on the UV curable-type ink ejected onto each unit area of the medium, the UV light with the second energy higher than the first energy is irradiated; when the second mode is set for printing an image with a glossiness higher than that of the image printed according to the first mode, control is carried out so that the UV light with an energy higher than that of the first energy is irradiated on the UV curable-type ink ejected on the unit area of the medium. The other characteristic features of the invention will be described in the present specification and its annexed figures.

BRIEF DESCRIPTION OF THE DRAWINGS

Referring now to the attached drawings which form a part of this original disclosure:

FIG. 2 is a schematic cross-sectional view illustrating the printers in Application Examples 1 to 4;

FIG. 3A to FIG. 3C are diagrams illustrating the printing method of a comparative example;

FIG. 6C is a diagram illustrating the case in which both of the adjacent LEDs are turned on;

DETAILED DESCRIPTION OF EXEMPLARY EMBODIMENTS

Figure 1:
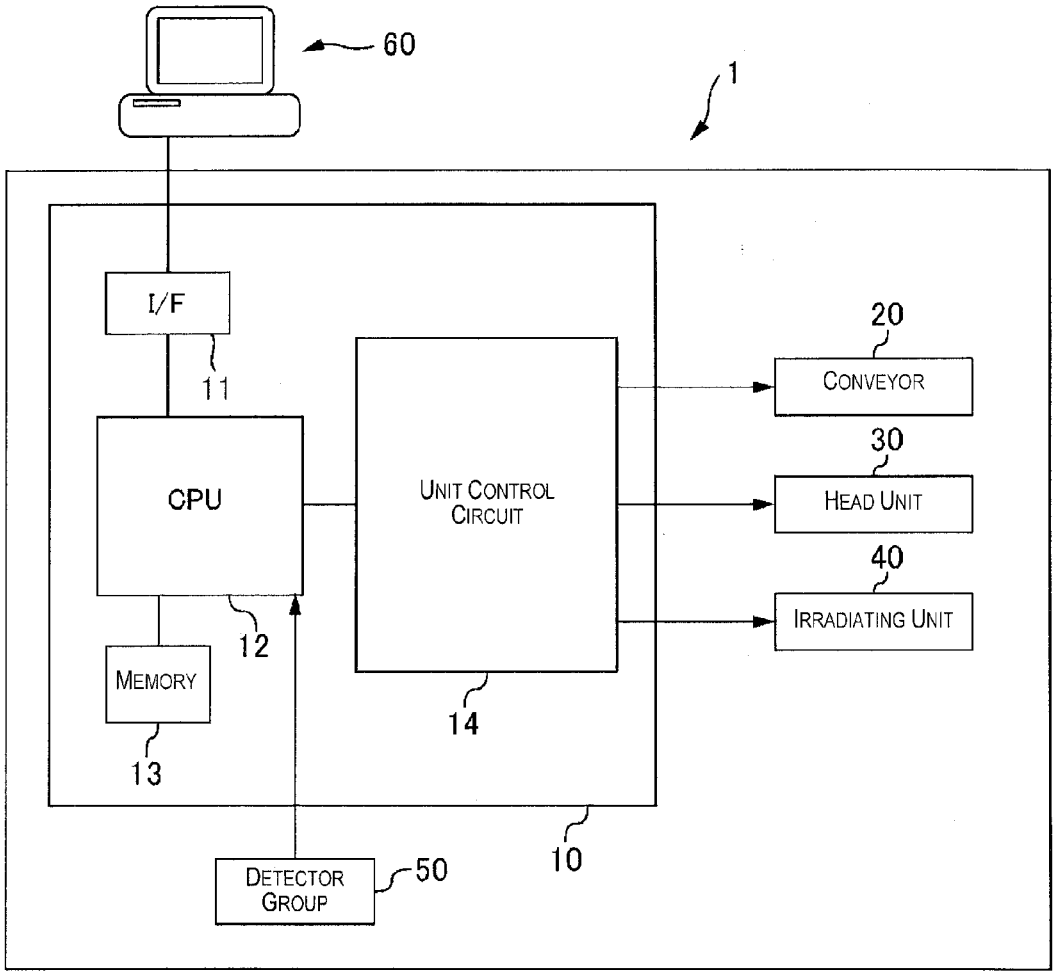
FIG. 1 is a block diagram illustrating the overall configuration of the printer.

From the description of the present specification and the annexed figures, at least the following features are presented.

That is, the invention provides a printing apparatus having (A) a head unit that ejects a yellow UV curable-type ink onto a medium, (B) an irradiating section that irradiates the UV light, and (C) a controller that works as follows: when the first mode is set, control is carried out so that, after the UV light with the first energy is irradiated on the UV curable-type ink ejected onto each unit area of the medium, the UV light with the second energy higher than the first energy is irradiated; when the second mode is set for printing an image with a glossiness higher than that of the image printed according to the first mode, control is carried out so that the UV light with an energy higher than that of the first energy is irradiated on the UV curable-type ink ejected onto the unit area of the medium. With this printing apparatus, it is possible to print the image with a glossiness corresponding to the printing mode, and it is possible to print the matte image with an excellent scratch resistance.

With the printing apparatus, the medium is conveyed to the downstream side of the conveyance direction with respect to the irradiation section. There are plural LEDs in the irradiation section; the number of the LEDs turned on for the unit area for the upstream portion with respect to the conveyance direction in the D irradiation section in the first mode is less than that for the downstream portion with respect to the conveyance direction in the irradiation section in the first mode and in the irradiation section in the second mode. In this printing apparatus, for the UV curable-type ink, it is possible to irradiate the UV light with a higher energy after irradiating the UV light with a lower energy in the first mode; it is also possible to irradiate the UV light with a higher energy from the start in the second mode.

In this printing apparatus, in the irradiation section, plural LED rows, each of which has plural LEDs set side by side in the direction crossing the conveyance direction, are set side by side in the conveyance direction; in the upstream portion with respect to the conveyance direction in the irradiation section in the first mode, for the LEDs of the LED rows adjacent to each other in the conveyance direction and turned on, respectively, their positions in the crossing direction are shifted from each other. With this printing apparatus, the energy of the UV light initially irradiated in the first mode can be further decreased.

In this printing apparatus, the medium is conveyed to the downstream side in the conveyance direction with respect to the irradiation section; in the irradiation section, the plural LED rows, each of which has plural LEDs set side by side in the direction crossing the conveyance direction, are set side by side in the conveyance direction; in the upstream portion with respect to the conveyance direction in the irradiation section in the first mode, the positions of the LEDs belonging to the LED rows adjacent to each other in the conveyance direction are shifted from each other in the crossing direction; in the downstream portion with respect to the conveyance direction in the irradiation section in the first mode and in the irradiation section in the second mode, the positions of the LEDs, which belong to the LED rows adjacent to each other in the conveyance direction, are aligned with each other in the crossing direction. In this printing apparatus, for the UV curable-type ink, it is possible to irradiate the UV light with a higher energy after the irradiation of the UV light with a lower energy in the first mode, and it is possible to irradiate the UV light with a higher energy from the start in the second mode In this printing apparatus, the medium is conveyed to the downstream side in the conveyance direction with respect to the irradiation section; in the irradiation section, the plural LED rows, each of which has plural LEDs set side by side in the direction crossing the conveyance direction, are set side by side in the conveyance direction; and the interval between the LED rows in the conveyance direction for the upstream portion in the conveyance direction of the irradiation section in the first mode is larger than that of the downstream portion in the conveyance direction of the irradiation section in the first mode and the irradiation section in the second mode. In this printing apparatus, for the UV curable-type ink, it is possible to irradiate the UV light with a higher energy after the irradiation of the UV light with a lower energy in the first mode, and it is possible to irradiate the UV light with a higher energy from the start in the second mode. In this printing apparatus, there is also a conveyor that supports the medium at the position facing the head unit and conveys the medium to the downstream side in the conveyance direction; the irradiation section has an upstream portion located on the upstream side in the conveyance direction and a downstream portion located on the downstream side in the conveyance direction; the upstream portion can be moved in the direction crossing the irradiated surface of the upstream portion; when the first mode is set, the first distance from the irradiated surface to the supporting section of the medium in the downstream portion in the conveyance direction is longer than the second distance from the downstream portion in the conveyance direction to the supporting section of the medium; when the second mode is set, the first distance is shorter than the second distance. In this printing apparatus, it is possible to print the image with a glossiness corresponding to the printing mode.

In this printing apparatus, there is also a head unit that ejects the cyan and/or the magenta UV curable-type ink onto the medium, and the cyan and/or the magenta UV curable-type ink contains an assisting agent that absorbs the light at the peak wavelength of the irradiating section. With such a printing apparatus, it is possible to print the matte image more reliably.

In this printing apparatus, there is also a head unit that ejects a black UV curable-type ink onto the medium. With such printing apparatus, it is possible to print a matte image with high scratch resistance.

In addition, the invention provides a printing method, whereby (A) according to this printing method, a yellow UV curable-type ink is ejected onto a medium; (B) when the first mode is set, by the irradiating section that irradiates the UV light, after the UV light with the first energy is irradiated onto the UV curable-type ink ejected onto each unit area of the medium, the UV light with the second energy higher than the first energy is irradiated; (C) when the second mode is set for printing an image with a glossiness higher than that of the image printed according to the first mode, by the irradiating section, the UV light with an energy higher than that of the first energy is irradiated on the UV curable-type ink ejected on the unit area of the medium. With this printing method, it is possible to print images with a glossiness corresponding to the printing mode. In addition, it is possible to print matte images with a high scratch resistance.

Printing System

Figure 10:
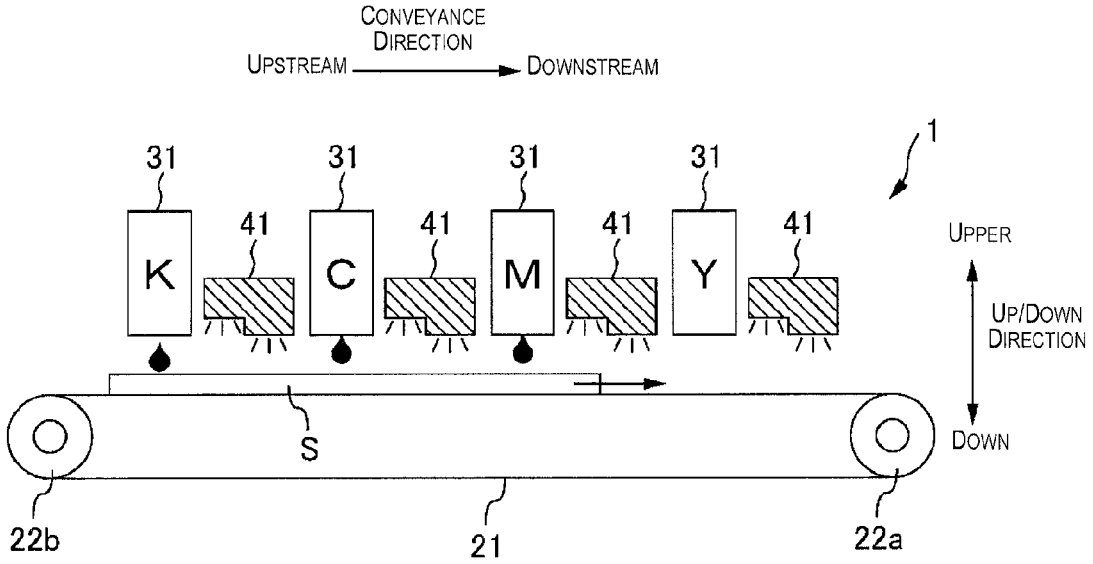
FIG. 10 is a schematic cross-sectional view illustrating the printers in Application Examples 5 to 7.

In the following, an embodiment will be explained with reference to an example of the printing system in which an inkjet printer (hereinafter to be referred to as the printer) is adopted as the "printing apparatus," and the printer and the computer are connected with each other. FIG. 1 is a block diagram illustrating the overall configuration of the printer 1. FIG. 2 is a schematic cross-sectional view illustrating the printer 1 related to Application Examples 1 to 4, which are to be explained later, as viewed in the lateral direction crossing the conveyance direction of the medium S. FIG. 10 is a schematic cross-sectional view illustrating the printer 1 related to Application Examples 5 to 7, which are to be explained later, as viewed in the lateral direction crossing the conveyance direction of the medium S. The printer 1 in this embodiment uses a UV curable-type ink (hereinafter to be referred to as the UV ink) that cures under the irradiation of UV light to print an image on a medium S (e.g., a paper sheet, cloth, plastic film, etc.). Here, the UV ink contains a photopolymerization initiator, a UV curable resin (monomer or oligomer), a coloring agent, etc. When the UV ink is irradiated with the UV light, the photopolymerization initiator absorbs the light and generates radicals and other active seeds, which cause the polymerization reaction of the UV curable resin, so that the UV ink is cured.

The computer 60 is connected to the printer 1 so that communication can be made between them. By the printer driver installed inside it, the printing data for printing the image with the printer 1 is output to the printer 1. The printer driver can be recorded in a CD-ROM or other recording media, or the printer driver can be downloaded via the internet to the computer 60.

The double-sided printer 10 is a controller that controls the printer 1. The double-sided printer has an interface section 11, a CPU 12, a memory 13, and a unit control circuit 14. The interface section 11 carries out data transmission/reception between the computer 60 as an external device and the printer 1. The CPU 12 is an arithmetic and logic operation step for carrying out the overall control of the printer 1. The memory 13 is for guaranteeing the program storage region, the operation region, etc. Here, according to the program stored in the memory 13, the CPU 12 controls the various units via the unit control circuit 14. Also, the state in the printer 1 is monitored by the detector group 50; on the basis of the detection result, the controller 10 controls the various units.

The conveyor 20 is for conveying the medium S on the conveyance direction. The conveyor has a conveyor belt 21 and conveyor rollers 22*a*, 22*b*. As a motor not shown in the figure rotates, the conveyor rollers 22*a*, 22*b* are rotated, so that the conveyor belt 21 is rotated. As a result, the medium S on the conveyor belt 21 is conveyed to the downstream side in the conveyance direction. The medium S faces the head 31 and the LED irradiating section 41 as the medium is conveyed on the conveyor belt 21.

The head unit 30 is for ejecting the UV ink onto the medium S, and the head unit has plural heads 31. According to the present embodiment, the printer 1 can eject 4 color UV inks (KCMY). As shown in FIG. 2 and FIG. 10, the following heads are arranged side by side from the upstream side in the conveyance direction: a head 31 that ejects the black UV ink K, a head 31 that ejects the cyan UV ink C, a head 31 that ejects the magenta UV ink M, and a head 31 that ejects the yellow UV ink Y.

On the lower surfaces of the heads 31, the plural nozzles serving as the UV ink ejecting ports are opened and are arranged side by side with a prescribed interval in the lateral direction crossing the conveyance direction of the medium S. The length of the row of the nozzle opening in the lateral direction is over the maximum width of the medium S. When the medium S passes under the head 31, the head 31 ejects the UV ink onto the medium S, so that two-dimensional image is printed on the medium S.

As far as the inkjet system for ejecting the ink from the nozzle opening is concerned, one can also adopt the piezoelectric system wherein a voltage is applied to a driving element (the piezoelectric element) so that the ink chamber is expanded/contracted to eject the ink through the nozzle opening; one can also adopt the thermal system wherein a heat generating element is used to generate bubbles in the nozzle, and, by the bubbles, the ink is ejected through the nozzle opening.

Figure 6A:
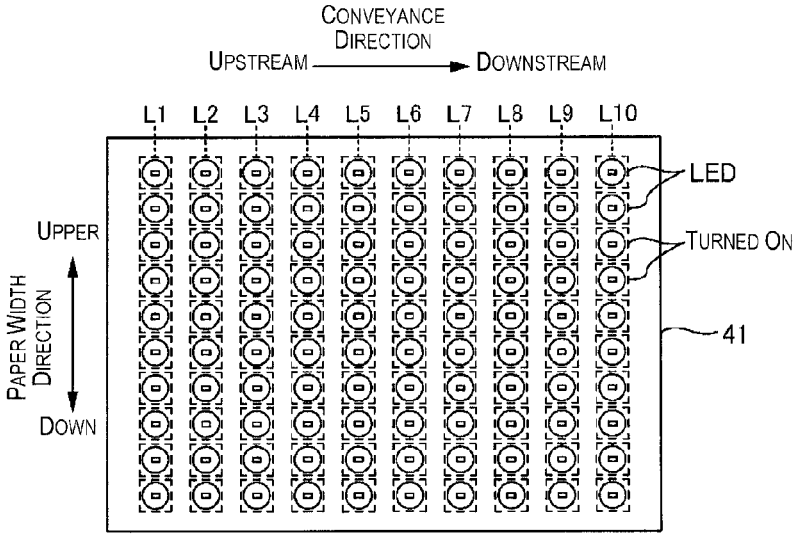
FIG. 6A and FIG. 6B are diagrams illustrating the LED irradiating section in Application Example 1.
Figure 6B:
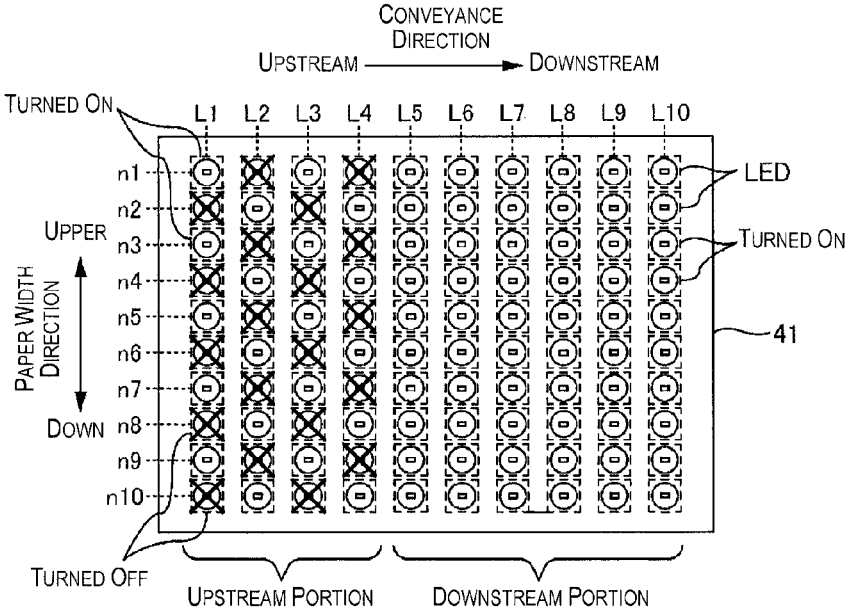
Figure 6C:
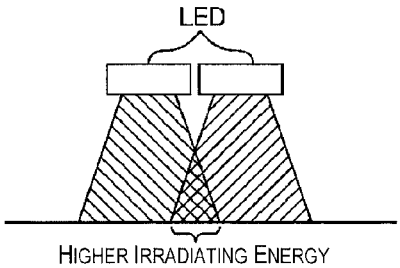

The irradiating unit 40 irradiates UV light (light) on the UV ink on the medium S for curing the UV ink. The irradiating unit has an LED irradiating section 41. According to the present embodiment, the light-emitting diode (LED) is adopted as the irradiating light source of the UV light; on the lower surface of the LED irradiating section 41 (the surface facing the medium S), plural LEDs (an LED package having LED elements) are arranged as shown in FIGS. 6A to 6C to be explained later. The irradiating unit 40 has the same number of 4 LED irradiating sections 41 as the heads 31, and 1 LED irradiating section 41 is arranged on the downstream side in the conveyance direction of each head 31, respectively. Consequently, the UV ink ejected from a head 31 onto the medium S is cured by the UV light emitted from the LED irradiating section 41 located on the downstream side right from the corresponding head 31.

In addition, the UV ink is cured by the light from the LED irradiating section 41. Here, the adopted LED irradiating section 41 irradiates the light at the wavelength for absorption by the photopolymerization initiator in the UV ink. According to the present embodiment, the LED irradiating section 41 with a peak wavelength at 395 nm is adopted. However, this peak wavelength is not exclusive. One can also use any LED irradiating section 41 having the peak wavelength in the range of 355 nm to 420 nm just as that for curing the well-known UV ink.

Also, the configuration is not limited to the configuration as shown in FIG. 2 and FIG. 10, wherein an LED irradiating section 41 is arranged for each head 31. For example, one can also adopt a configuration in which only 1 LED irradiating section 41 is arranged at the position on the farthest downstream side in the conveyance direction. Here, the irradiating energy of the UV light irradiated on the UV ink ejected onto the unit area of the medium S ($mJ/cm^2$) is determined as the product of the UV light irradiation intensity ($mW/cm^2$) and the irradiating time(s).

As to be explained later, the ejected ink quantity on unit area of the medium S (in other words, the proportion of the "number of pixels forming the dots" among the "number of pixels in the unit area of the medium S") is called the "ink duty". Here, a higher ink duty refers to a larger ink quantity ejected onto the unit area of the medium S; on the contrary, a lower ink duty refers to a smaller ink quantity ejected onto the unit area of the medium S. In addition, the image (including the monochromic image) printed by using the 4 color UV inks (KCMY) appropriately is called the color image.

Printing Mode

The printer 1 of the present embodiment has the "matte mode" and the "glossy mode," so that printing is carried out with a different glossiness corresponding to the difficult applications of the user. When the mode is set at the matte mode, the printer 1 prints the matte image with a lower glossiness than the image printed in the glossy mode, with a larger concavo-convex shape on the image surface so that the light irradiated on the image is randomly reflected. On the other hand, when the mode is set at the glossy mode, the printer 1 prints the glossy image with a higher glossiness than that of the image printed in the matte mode as the image surface is smoother.

Printing Method of the Comparative Example

FIG. 3A to FIG. 3C are diagrams illustrating the printing method in the comparative example. FIG. 3A shows the color image with a lower ink duty. FIG. 3B is a diagram illustrating the color image with a higher color image. According to the printing method in the comparative example shown in FIG. 3A and FIG. 3B, in the case when the matte mode is set, for the color image, the light (UV light) with a higher energy is irradiated from the beginning, so that the color image is cured at a single stretch from the outer layer portion to the interior.

As the UV ink has a relatively higher viscosity, the UV ink droplets take on a bulging state right after they hit the medium S. Consequently, when a color image with a lower ink duty is printed, as shown in FIG. 3A, the various UV ink droplets hit the medium S at positions separated from each other. Then, as the light with a higher energy is irradiated, the granular-shaped UV ink droplets are cured at a single stretch while they are independent from each other. Consequently, the image surface takes on the concavo-convex shape, so that a matte image with a lower glossiness is printed.

On the other hand, when a color image with a higher ink duty is printed, most portions of the medium S are covered by the UV ink droplets, so that the UV ink droplets hitting the medium S are linked with each other. As a result, as shown in FIG. 3B, the surface of the image is made flat by the UV ink. Then, as the light with a higher energy is irradiated, the image has the outer surface layer to the interior cured at a single stretch. In this case, the surface of the image is cured in smooth state, and the glossiness of the image becomes higher. That is, a glossy image is printed instead of the matte image.

That is, when the color image with a lower ink duty is printed, even when the UV ink is cured by the light (UV light) with a higher energy at a single stretch, it is still possible to print the matte image. However, when a color image with a higher ink duty is printed, if the UV ink is cured by the light (UV light) with a higher energy at a single stretch, it is impossible to print a matte image.

FIG. 3C is a diagram illustrating the state in which the clear ink droplets are ejected on a color image. Even for the color image with a smooth surface and a higher ink duty as shown in FIG. 3B, when the clear ink droplets are sparingly ejected on the color image, the image surface can take on the concavo-convex shape, and it is possible to print a matte image. However, as the clear ink that is different from the ink that forms the color image forms the bumps, the clear ink can be separated easily from the color image, so that the scratch resistance is poor. Also, as the clear ink is used in addition to the inks for printing the color image, the cost rises.

Here, the purpose of the present embodiment is to provide a scheme whereby a matte image is printed with a high scratch resistance without using the clear ink even when a color image with a high ink duty is printed.

Printing Method of the Present Embodiment

Figure 4:
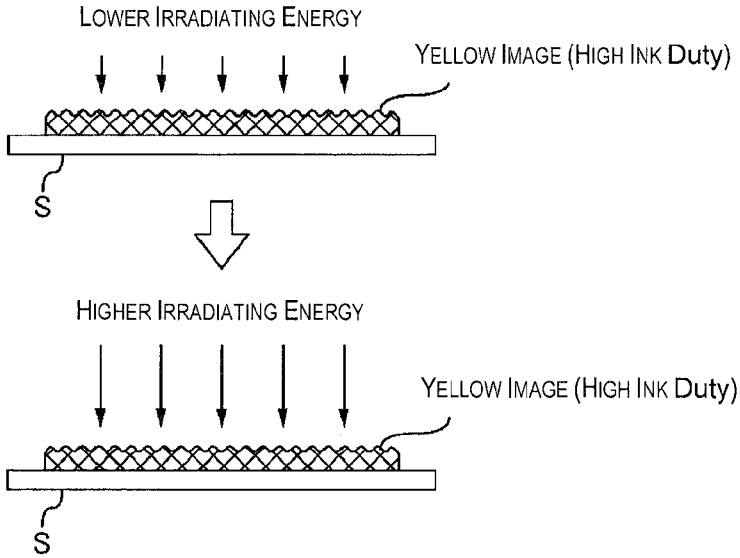
FIG. 4 is a diagram illustrating the printing method according to the present embodiment.

FIG. 4 is a diagram illustrating the printing method according to the present embodiment. According to the printing method of the present embodiment, when the matte mode is set, for example, for the yellow image formed from a yellow UV ink with a higher ink duty, initially, the light (UV light) with a lower energy is irradiated so that only the outer layer portion of the image is cured; then, the light (UV light) with a higher energy is irradiated so that the entirety of the image until the interior of the image is cured. As a result, as shown in FIG. 4, wrinkles form on the image surface, and the surface of the image can take on the concavo-convex shape. That is, it is possible to print a matte image.

It is believed that the development of the wrinkles on the image surface is caused by the following fact: initially, the light with a lower energy is irradiated so that only the outer layer portion of the image is cured; so that the shrinkage in the volume caused by the curing in the outer layer portion of the image is larger than that of the interior; and so that the volume balance between the outer layer portion and the interior of the image is lost, causing the wrinkles.

The wrinkling phenomenon on the surface of the image for the yellow UV ink image is more significant than that for the images formed from the magenta and the cyan UV inks. It is believed that the cause for this is as follows: the wavelength region contributing to the curing of the UV ink, that is, the wavelength region of the light absorbed by the photopolymerization initiator is contained in, or near, the wavelength region of the blue light. Consequently, for the yellow ink with an absorption region in the blue light wavelength region for absorbing the blue light, the absorption of the light in the wavelength region contributing to the curing is easier; thus, it is harder for the light to reach the interior of the image than the magenta and the cyan inks. That is, the yellow ink has a lower transmissivity of the light with wavelength contributing to curing than the magenta and the cyan inks. Consequently, when the light with a lower energy is initially irradiated as in the printing method in the present embodiment, the light does not reach the photopolymerization initiator in the interior of the yellow image, and only the outer layer portion of the image is cured. As a result, according to the printing method of the present embodiment, wrinkles are developed on the surface of the yellow image so that it is possible to form the image surface in a concavo-convex shape, and it is possible to print a matte yellow image.

Similarly, the coloring agent in the black UV ink can absorb the light at the wavelength contributing to curing more easily than the magenta and the cyan UV inks, so that the light can hardly reach the photopolymerization initiator in the interior of the image. Consequently, even for the image formed from the black UV ink, by initially irradiating the light with a lower energy, it is possible to cure only the outer layer portion of the image. As a result, wrinkles form on the surface of the black image, so that the surface can take on the concavo-convex shape. As a result, it is possible to print the matte black image.

Also, for the image that has a higher ink duty and is thicker, the wrinkling phenomenon on the surface can take place more easily, and it is easier to form the matte image. The reason is as follows: the thicker the image is, the harder it becomes for the light to reach the photopolymerization initiator in the interior of the image, and the interior of the image becomes more difficult to cure. Consequently, in the printing method of the comparative example shown in FIG. 3B, the higher the ink duty of the image is, the higher the glossiness becomes. However, according to the printing method of the present embodiment, the higher the ink duty of the image is, the easier it is for the wrinkles to form on the surface, and the easier it is to form the matte image.

In other words, when the glossy mode is set, the light (UV light) with a lower energy is initially irradiated to cure only the outer layer portion of the image, and the surface of the image takes on the concavo-convex shape. Consequently, it is impossible to print a glossy image with a higher glossiness.

Here, for the printer 1 of the present embodiment, when the matte mode (corresponding to the first mode) is set, under control by the controller 10, after irradiation of the UV light with a lower energy (corresponding to the first energy) for the UV ink ejected onto the unit area of the medium S, the UV light with a higher energy (corresponding to the second energy) is irradiated. On the other hand, when the glossy mode (corresponding to the second mode) is set, under control by the controller 10, the UV light with an energy higher than the initially irradiated energy (the first energy) in the matte mode is irradiated from the start.

As a result, in the matte mode, only the outer layer portion of the image using the yellow and the black inks, wrinkles form on the surface of the image, and the surface of the image can take on the concavoconvex shape. Consequently, even when the image with a high ink duty is printed, it is possible to print a matte image with a lower glossiness without using the clear ink. Also, as the light (UV light) with a higher energy is irradiated after irradiation with the light (UV light) with a lower energy, the entirety of the image is cured, and the image can be fixed on the medium S. Also, as the surface of the image takes on the concavoconvex shape without using the clear ink, it is possible to print a matte image with high scratch resistance. Also, because no clear ink is in use, it is possible to cut the cost.

In addition, when an image with a lower ink duty is printed, even when the UV light with a lower energy is not irradiated initially, that is, even when the UV light with a high energy is irradiated from the start, it is still possible print the matte image as shown in FIG. 3A. However, according to the present embodiment, when the matte mode is set, the UV light having a higher energy is irradiated after irradiation with the UV light having a lower energy irrelevant to the ink duty. As a result, it is easy for the controller 10 to carry out control.

On the other hand, because the entire image can be cured at a single stretch in the glossy mode, it is possible to cure the image with a smooth surface of the image. Consequently, as shown in FIG. 3B, when an image with a high ink duty is printed, it is possible to print a glossy image with a smooth image surface and with a higher glossiness. On the other hand, when an image with a lower ink duty is printed, by ejecting the clear ink on the image, it is possible to print a glossy image with a smooth image surface and a higher glossiness.

As explained above, even when the light (UV light) with a lower energy is irradiated initially, for the image formed from the magenta and the cyan inks, it is easier to cure to the interior of the image, and it is harder to form wrinkles on the image surface than the image formed from the yellow and the black inks. That is, it is more difficult to form a matte image. However, the magenta and the cyan inks are usually superposed on the yellow and the black inks. As a result, although it is difficult to form an concavo-convex surface for the image of the magenta and the cyan inks, it is, nevertheless, easier to form the concavo-convex surface of the image of the yellow and black inks, so that it is possible to form an concavo-convex surface for the overall image, and thus it is possible to print a matte image.

The probability of using the yellow ink superposed on the magenta and the cyan inks is higher than that of using the black ink superposed on the magenta and the cyan inks. Here, as shown in FIG. 2 and FIG. 10, the head 31 for ejecting the yellow ink is arranged on the downstream most side in the conveyance direction. As a result, it is possible to form the yellow ink image, which is easier to form the concavo-convex shape, on the image of the magenta and the cyan inks. Consequently, it is possible to arrange the surface of the yellow ink image on the outer surface of the overall image, so that it is easier to form the concavo-convex shape for the overall image. As a result, it is possible to print the matte image with an even higher reliability. However, the invention is not limited to the scheme. For example, the head 31 for ejecting the black ink can also be arranged on the downstream most side in the conveyance direction. In this case, too, it is possible to form the black ink image that can easily form the concavo-convex shape as the surface of the overall image, so that it is possible to print the matte image with a consistently high reliability.

Printing Method

Application Example 1

Figure 5:
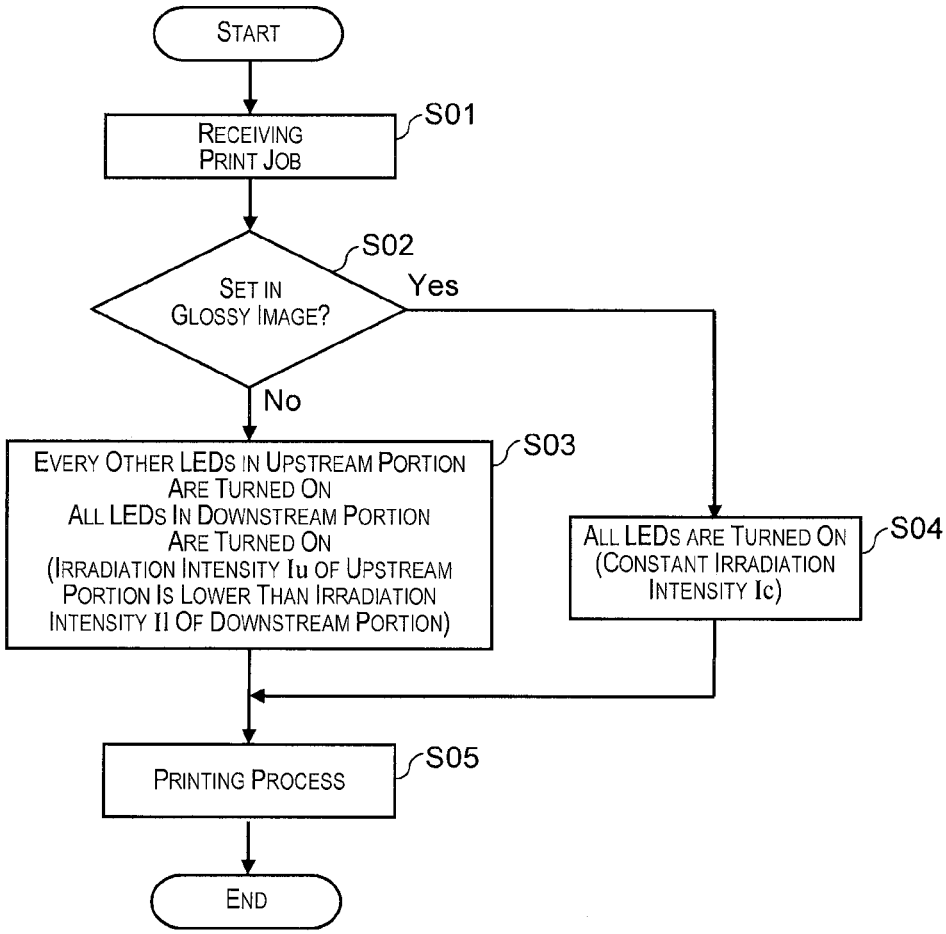
FIG. 5 is a flow chart illustrating the printing method in Application Example 1.

FIG. 5 includes flow charts illustrating the printing method according to Application Example 1. Here, FIG. 6A and FIG. 6B are diagrams illustrating the LEDs arranged on the lower surface of the LED irradiating sections 41 in Application Example 1. FIG. 6A is a diagram illustrating the LED irradiating sections 41 in the glossy mode. FIG. 6B is a diagram illustrating the LED irradiating sections 41 in the matte mode. As shown in FIG. 2, the LED irradiating sections 41 that are arranged on the downstream side of the heads 31, respectively, correspond to the LED irradiating sections 41 shown in FIG. 6A and FIG. 6B.

On the downstream side of each LED irradiating section 41, 10 LEDs (n1 to n10) are arranged at a prescribed interval from each other to form an "LED row" in the lateral direction crossing the conveyance direction of the medium S. There are 10 such LED rows. The 10 LED rows (L1 to L10) are arranged side by side in the conveyance direction. In the following, in order to facilitate the explanation, the LED rows are numbered in an ascending order from the LED row positioned on the upstream side of the conveyance direction (L1, L2, . . . ), and the LEDs are numbered in an ascending order from the upper side in the lateral direction (n1, n2, . . . ).

In Application Example 1, control is carried out so that the number of the LEDs in ON state for the unit area in the upstream portion in the conveyance direction (hereinafter to be referred to as the upstream side) in the LED irradiating sections 41 in the matte mode (FIG. 6B) is smaller than that in the downstream portion in the conveyance direction (hereinafter to be referred to as downstream side) in the LED irradiating sections 41 in the matte mode (FIG. 6B) and then that in the LED irradiating sections 41 in the glossy mode (FIG. 6A). As a result, in the matte mode, for the UV ink on the medium S, it is possible to irradiate the UV light with a higher energy after irradiation of the UV light (light) with a lower energy; in the glossy mode, it is possible to irradiate the UV light with a higher energy on the UV ink on the medium S from the start.

Here, among the LED irradiating sections 41, the region including the 4 LED rows (L1 to L4) on the upstream side in the conveyance direction is taken as the "upstream portion," and the region including the 6 LED rows (L5 to L10) on the downstream side in the conveyance direction is taken as the "downstream side". However, the invention is not limited to this configuration. The number of the LED rows belonging to the upstream portion can be increased or decreased.

In the following, according to the flow chart shown in FIG. 5, the flow chart of the printing method will be explained in more detail. First of all, as the controller 10 receives the print job (S01), the controller checks whether the printing mode is set at the glossy mode or the matte mode (S02). For example, when the user sets the printing mode in the computer 60 where the printer driver is installed, the controller 10 acquires the information related to the printing mode from the printer driver and checks the printing mode.

Then, when the printing mode is set at the "glossy mode" (Y in S02), as shown in FIG. 6A, the controller 10 turns on all of the LEDs of the LED irradiating sections 41. Consequently, independent of the position in the conveyance direction, the number of the LEDs turned on for unit area is constant. As a result, in the glossy mode, independent of the position in the conveyance direction, the irradiation intensity Ic of the LED irradiating sections 41 can be kept higher and constant.

On the other hand, when the printing mode is set at the "matte mode" (N in S02), as shown in FIG. 6B, the controller 10 turns on 1 LED belonging to each of the upstream-portion LED rows (L1 to L4) of the LED irradiating sections 41, while the controller turns on all of the LEDs belonging to the upstream-portion LED rows (L5 to L10). Consequently, the number of the LEDs turned on for the unit area in the upstream portion is smaller than that in the downstream portion. Also, the irradiation intensity Iu in the upstream portion of the LED irradiating sections 41 can be lower than that of the irradiation intensity Il of the downstream portion (Iu<Il). In addition, the number of the LEDs turned on for the unit area in the upstream portion in the LED irradiating sections 41 in the matte mode (FIG. 6B) is smaller than that of the LED irradiating sections 41 in the glossy mode (FIG. 6A). Consequently, the irradiation intensity Iu of the upstream portion in the LED irradiating sections 41 in the matte mode is lower than the irradiation intensity Ic of the LED irradiating sections 41 in the glossy mode (Iu<Il, Ic).

FIG. 6C is a diagram illustrating the case in which both LEDs adjacent to each other in the conveyance direction and in the lateral direction are turned on. As the light rays irradiated from the LEDs are gradually spread, when both of the LEDs adjacent to each other in the conveyance direction and the lateral direction are turned on, their irradiating ranges are partially overlapped with each other. The irradiation intensity in the overlapped region is higher, and the energy of the light (UV light) irradiated on the UV ink when passing through the region is higher.

Here, in the matte mode, in the upstream portion of the LED irradiating sections 41 (FIG. 6B), the positions of the LEDs turned on in the LED rows adjacent to each other in the conveyance direction (e.g., L1 and L2) have their lateral positions shifted from each other. More specifically, for the odd-numbered LED rows (L1, L3), the odd-numbered LEDs (n1, n3, n5, . . . ) are turned on, while for the even-numbered LED rows (L2, L4), the even-numbered LEDs (n2, N4, n6, . . . ) are turned on. As a result, in the upstream portion of the LED irradiating sections 41, the irradiation ranges of the LEDs that are overlapped with each other is none or is reduced, so that it is possible to lower the irradiation intensity Iu of the upstream portion. Consequently, in the matte mode, it is possible to cure only the outer layer portion of the image, and this contributes to the wrinkling of the image surface.

On the contrary, for the downstream portion in the LED irradiating sections 41 in the matte mode (FIG. 6B), and for the LED irradiating sections 41 in the glossy mode (FIG. 6A), both the LEDs adjacent in the conveyance direction and the lateral direction are turned on, so that the LED irradiation ranges are overlapped with each other, and thus the irradiation intensities Il, Ic can be higher. As a result, in the matte mode, the interior of the image that failed to be cured in the upstream portion of the LED irradiating sections 41 can be cured in the downstream portion. In the glossy mode, the entire image can be cured at a single stretch, so that the surface of the image can be cured to a smooth state.

After control is made on the number of the LEDs turned on, the controller 10 executes the printing process (S05). As a result, as shown in FIG. 2, on the medium S conveyed on the conveyor belt 21, inks are ejected from the heads 31 for the various colors, respectively, and the inks are cured on the medium S by the LED irradiating sections 41. Here, the conveying speed of the medium S beneath the LED irradiating sections 41 is kept constant.

As a result, in the glossy mode (FIG. 6A), the irradiation intensity Ic is constant, independent of the position in the conveyance direction, and the medium S passes beneath the LED irradiating sections 41 at a higher irradiation intensity Ic. Consequently, initially, the light (UV light) with a higher energy is irradiated from the start on the UV inks on the medium S, and the entirety of the image is cured from the outer layer portion of the image to its interior at a single stretch. As a result, the image is cured with a smooth surface, and it is possible to print a glossy image with a high degree of glossiness.

On the other hand, in the matte mode (FIG. 6B), the irradiation intensity Iu of the upstream portion is lower, while the irradiation intensity Il of the downstream portion is higher as the medium S passes beneath the LED irradiating sections 41. Consequently, the UV inks on the medium S are initially irradiated by the light (UV light) with a lower energy in the upstream portion and then by the light (UV light) with a higher energy in the downstream portion. Also, for the image made of the yellow ink and the black ink, the outer layer portion of the image is initially cured, so that wrinkles are developed on the surface of the image and so that the surface of the image takes on the concavo-convex shape. As a result, for the image formed from the yellow ink and/or the black ink, the surface of the overall image takes on the concavo-convex shape, and it is possible to print the matte image with a lower glossiness. In this way, according to the printing method of Application Example 1, it is possible to print the matte image with a high scratch resistance without using a clear ink.

Here, in the matte mode, some LEDs belonging to the upstream portion of the LED irradiating sections 41 are turned off. However, the invention is not limited to this configuration. One can also adopt a scheme in which the LEDs are covered with a filter that cuts off the light (UV light) not contributing to curing of the UV inks. In this case, too, it is possible to have the irradiation intensity Iu of the upstream portion in the LED irradiating sections 41 lower than that of the irradiation intensity Il of the downstream portion in the matte mode.

Printing Method

Application Example 2

Figure 7A:
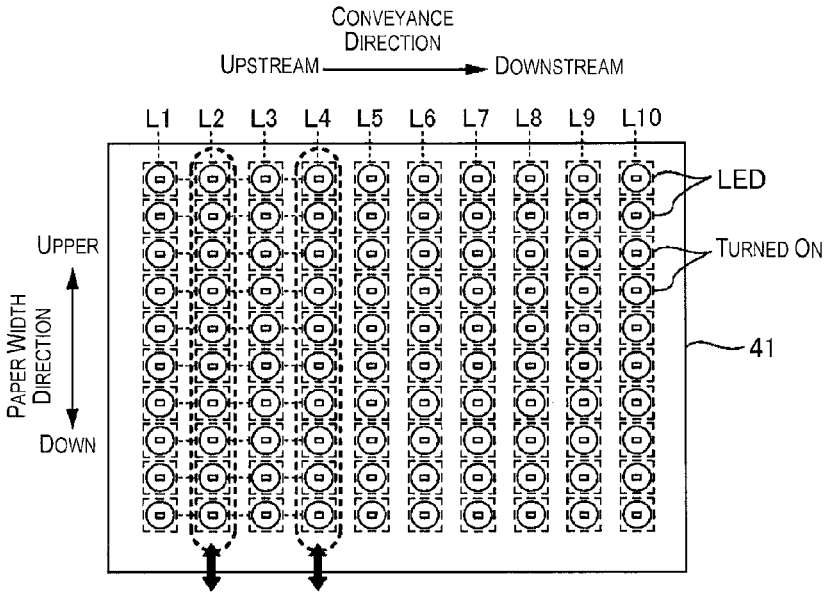
FIG. 7A is a diagram illustrating the LED irradiating section in the glossy mode in Application Example 2.
Figure 7B:
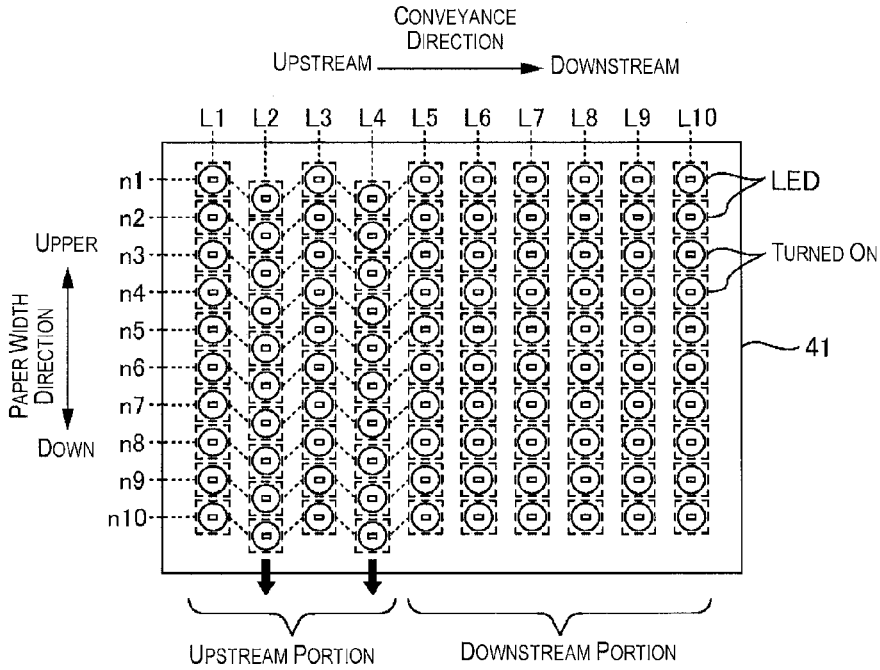
FIG. 7B is a diagram illustrating the LED irradiating section of the matte mode in Application Example 2.

FIG. 7A is a diagram illustrating the LED irradiating sections 41 in the glossy mode according to Application Example 2. FIG. 7B is a diagram illustrating the LED irradiating sections 41 in the matte mode according to Application Example 2. According to Application Example 2, the controller 10 adjusts the "positions of the LED rows in the lateral direction" corresponding to the printing mode. For this purpose, the LED irradiating sections 41 adopted in Application Example 2 have a configuration in which the second and fourth LED rows (L2, L4) counted from the upstream side in the conveyance direction can move in the lateral direction. Here, to simplify the explanation, the moving mechanism for the LED rows is not shown.

More specifically, when the printing mode is set at the "glossy mode," as shown in FIG. 7A, the controller 10 issues a control so that the positions of the LEDs belonging to the LED rows adjacent to each other in the conveyance direction (e.g., L1 and L2) are aligned with each other and so that all of the LEDs are turned on. As a result, as shown in FIG. 6C, the irradiation ranges of the LEDs adjacent to each other in the conveyance direction and the lateral direction are overlapped with each other, and the irradiation intensity Ic of the LED irradiating sections 41 can be increased. Also, because the lateral positions of the LEDs belonging to all of the LED rows (L1 to L10) are aligned, it is possible to keep a constant irradiation intensity Ic of the LED irradiating sections 41 independent of the position in the conveyance direction.

Consequently, in the glossy mode, the light (UV light) with a higher energy is irradiated from the start on the UV inks on the medium S, so that the entirety of the image from the outer layer portion to the interior of the image can be cured at a single stretch. As a result, it is possible to cure the image with a smooth surface, and it is possible to print the glossy image with a high degree of glossiness.

On the other hand, when the printing mode is set at the "matte mode," as shown in FIG. 7B, the controller 10 issues a control so that, in the upstream portion of the LED irradiating sections 41, the lateral positions of the LEDs belonging to the LED rows adjacent to each other in the conveyance direction (e.g., L1 and L2) are shifted from each other, and, in the downstream portion, the lateral positions of the LEDs belonging to the LED rows adjacent in the conveyance direction (e.g., L5 and L6) are aligned with each other. In addition, the controller 10 turns on all of the LEDs.

Under the control of the controller 10, among the LED rows in the upstream portion (L1 to L4), the second and fourth LED rows counted from the upstream side in the conveyance direction (L2 and L4) are shifted forward in the lateral direction. The distance of the shift of the LED rows (L2, L4) is half of the interval of the LEDs arranged side by side in the lateral direction. As a result, for example, at the center of the first and second LEDs (n1, n2) counted from the head in the lateral direction belonging to the first LED row (L1), the first LED (n1) counted from the head in the lateral direction belonging to the second LED row (L2) can be arranged. Here, the shift distance of the LED rows (L2, L4) is not limited to the half interval between the adjacent LEDs arranged side by side in the lateral direction. The shift distance can be shorter or longer than the half interval.

In this way, in the upstream portion of the LED irradiating section 41, by shifting the lateral positions of the LEDs belonging to the LED rows adjacent to each other in the conveyance direction, it is possible to eliminate or reduce the regions wherein the irradiation ranges of the LEDs adjacent in the conveyance direction, and it is possible to decrease the irradiation intensity Iu of the upstream portion. On the other hand, in the downstream portion of the LED irradiating sections 41, as the lateral positions of the LEDs belonging to the LED rows adjacent to each other in the conveyance direction are aligned with each other, it is possible to have the irradiation ranges of the LEDs adjacent to each other in the conveyance direction and the lateral direction overlapped with each other, so that it is possible to increase the irradiation intensity Il of the downstream portion.

That is, it is possible to have the irradiation intensity Iu of the upstream portion of the LED irradiating sections 41 lower than the irradiation intensity Il of the downstream portion in the matte mode. Also, it is possible to have the irradiation intensity Iu of the upstream portion of the LED irradiating sections 41 in the matte mode be lower than the irradiation intensity Ic of the LED irradiating sections 41 in the glossy mode (Iu<Il, Ic).

Consequently, in the matte mode, the UV inks on the medium S are initially irradiated by the light (UV light) with a lower energy in the upstream portion, and they are then irradiated by the light (UV light) with a higher energy in the downstream portion. As a result, for the image formed from the yellow and the black inks, initially, only the outer layer portion of the image is cured; the wrinkles are developed on the surface of the image; and the surface of the overall image takes on the concavo-convex shape. As a result, a matte image can be printed. In this way, according to the printing method of Application Example 2, it is possible to print the matte image with high scratch resistance without using the clear ink.

Printing Method

Application Example 3

Figure 8A:
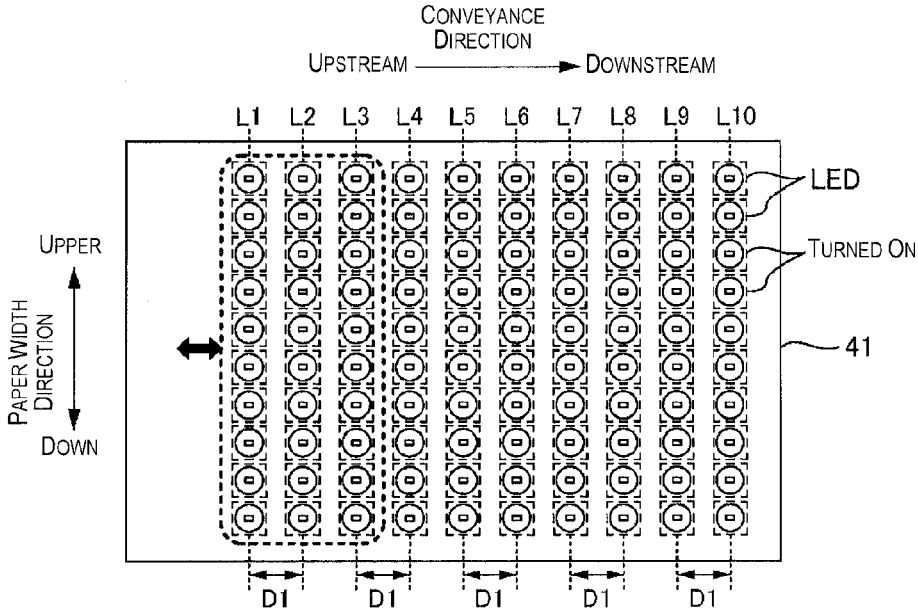
FIG. 8A is a diagram illustrating the LED irradiating section in the glossy mode in Application Example 3.
Figure 8B:
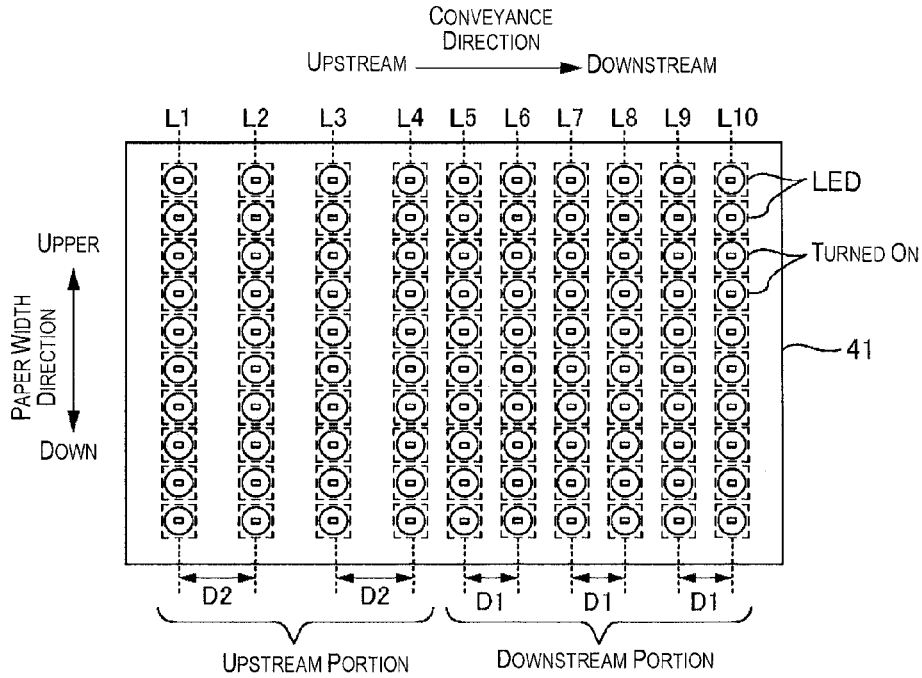
FIG. 8B is a diagram illustrating the LED irradiating section of the matte mode in Application Example 3.

FIG. 8A is a diagram illustrating the LED irradiating sections 41 in the glossy mode according to Application Example 3. FIG. 8B is a diagram illustrating the LED irradiating sections 41 in the matte mode according to Application Example 3. In Application Example 3, the controller 10 adjusts the "interval between the LED rows in the conveyance direction" corresponding to the printing mode. For this purpose, for the LED irradiating sections 41 adopted in Application Example 3, the 3 LED rows (L1 to L3) counted from the upstream side in the conveyance direction can move in the conveyance direction. However, to facilitate the explanation, the moving mechanism for the LED rows is not shown FIGS. 8A and 8B.

More specifically, when the printing mode is set at the "glossy mode" as shown in FIG. 8A, the controller 10 issues a control so that the interval D1 between the LED rows in the conveyance direction is shorter and so that all of the LEDs are turned on. As a result, as shown in FIG. 6C, the irradiation ranges of the LEDs adjacent to each other in the conveyance direction and the lateral direction are overlapped with each other, and the irradiation intensity Ic of the LED irradiating sections 41 can become higher. Here, controller 10 issues a control so that the interval D1 between all of the LED rows (L1 to L10) in the conveyance direction is kept constant. As a result, a constant irradiation intensity Ic of the LED irradiating sections 41 independent of the position in the conveyance direction can be ensured.

As a result, in the glossy mode, the UV inks on the medium S are irradiated by the light (UV light) with a higher energy from the start, and the entirety of the image from the outer layer portion to the interior of the image is cured at a single stretch. Consequently, it is possible to cure the image while its surface is smooth, and it is possible to print the glossy image with a high degree glossiness.

On the other hand, when the printing mode is set at the "matte mode," the controller 10 issues controls as follows: as shown in FIG. 8B, the interval D2 between the LED rows in the conveyance direction in the upstream portion of the LED irradiating sections 41 is larger, while the interval D1 between the LED rows in the downstream portion is smaller. Consequently, the controller 10 issues controls so that the 3 LED rows (L1 to L3) on the upstream side in the conveyance direction are shifted to the upstream side in the conveyance direction, while the interval D2 between the LED rows (L1 to L4) in the conveyance direction becomes larger. As the interval D2 between the LED rows in the conveyance direction is increased, the regions wherein the irradiation ranges of the LEDs adjacent in the conveyance direction are overlapped with each other is eliminated or decreased, and the irradiation intensity Iu of the upstream portion can become lower.

In this way, according to Application Example 3, the interval between the LED rows in the conveyance direction in the upstream portion of the LED irradiating sections 41 in the matte mode (FIG. 8B) is wider than that in the downstream portion of the LED irradiating sections 41 in the matte mode (FIG. 8B). In addition, the irradiation intensity Iu of the upstream portion of the LED irradiating sections 41 in the matte mode is lower than the irradiation intensity Ic of the LED irradiating sections 41 in the glossy image and than the irradiation intensity Il of the downstream portion of the LED irradiating sections 41 in the matte mode (Iu<Il, Ic).

As a result, in the matte mode, the UV inks on the medium S are first irradiated by the light (UV light) with a lower energy in the upstream portion and then irradiated by the light (UV light) with a higher energy in the downstream portion. Consequently, for the image formed from the yellow and the black inks, initially, only the outer layer portion of the image is cured, and the wrinkles are generated on the surface of the image, so that the image surface takes on the concavo-convex shape. Consequently, for the image formed from the yellow ink and/or the black ink, the surface of the overall image takes on the concavo-convex shape, and it is possible to print the matte image. In this way, according to the printing method of Application Example 3, it is possible to print the matte image with high scratch resistance without using the clear ink.

Printing Method

Application Example 4

As explained above, the LED irradiating sections 41 for irradiating the light at the wavelength absorbed by the photopolymerization initiator in the UV inks are in use. For this purpose, the peak wavelength of the LED irradiating sections 41 is contained in the wavelength region of the light absorbed by the photopolymerization initiator.

Compared with the coloring agents of the yellow and the black inks, it is more difficult for the magenta and the cyan inks to absorb the light at the wavelength contributing to curing of the UV inks, that is, the light at the wavelength absorbed by the photopolymerization initiator. Consequently, even when a light with a lower energy is initially irradiated on the image formed from the magenta and the cyan inks, the light still can reach the photopolymerization initiator inside of the image, so that the interior of the image can be cured easily. Consequently, for the image formed from the magenta and the cyan inks, the wrinkles can hardly be formed on the image surface, and it is difficult to form the matte image.

According to Application Example 4, the cyan and the magenta UV inks contain the assisting agent that absorbs the light at the peak wavelength of the LED irradiating sections 41. As a result, when the light (UV light) is irradiated on the image made of the cyan and the magenta inks, the light at the wavelength absorbed by the photopolymerization initiator is absorbed by the assisting agent, and the transmissivity of the light degrades.

Consequently, by initially irradiating the light (UV light) with a lower energy on the image formed from the cyan and the magenta inks in the matte mode, the light can hardly reach the photopolymerization initiator, so that the interior of the image is not cured and so that only the outer layer portion is cured. As a result, the image surface has wrinkles developed thereon, and the image surface is formed as an concavo-convex shape, so that it is possible to print the matte image.

In this way, according to Application Example 4, in addition to the image formed from the yellow and the black inks, for the image formed from the cyan and the magenta inks, the image surface can also be formed in concavo-convex shape, so that the embossing on the surface of the overall image can become more significant, and it is possible to print the matte image more reliably. Also, even when the yellow and the black inks are not used, it is still possible to print the matte image. Additionally, the assisting agent can be contained only in one of the cyan and the magenta inks.

Examples of the assisting agents that absorb the light at the peak wavelength (395 nm) of the LED irradiating section 41 are as follows: 1-(phenyl)ethanone, di(4-methoxy phenyl) diketone, 1,2-bis(phenyl)ethane dione, α-hydroxy-α-phenyl acetophenone, 1,2-diphenyl-2-ethoxy ethanone, 1,2-diphenyl-2-(isobutoxy)ethanone, 1,2-diphenyl-2-(isopropyloxy) ethane-1-one, 1-[(diphenyl phosphinyl)carbonyl]-2,4,6-trimethyl benzene, and 2-(methoxy carbonyl)benzophenone.

Modified Examples

Modified Example 1 of Application Examples 1 to 4

Figure 9A:
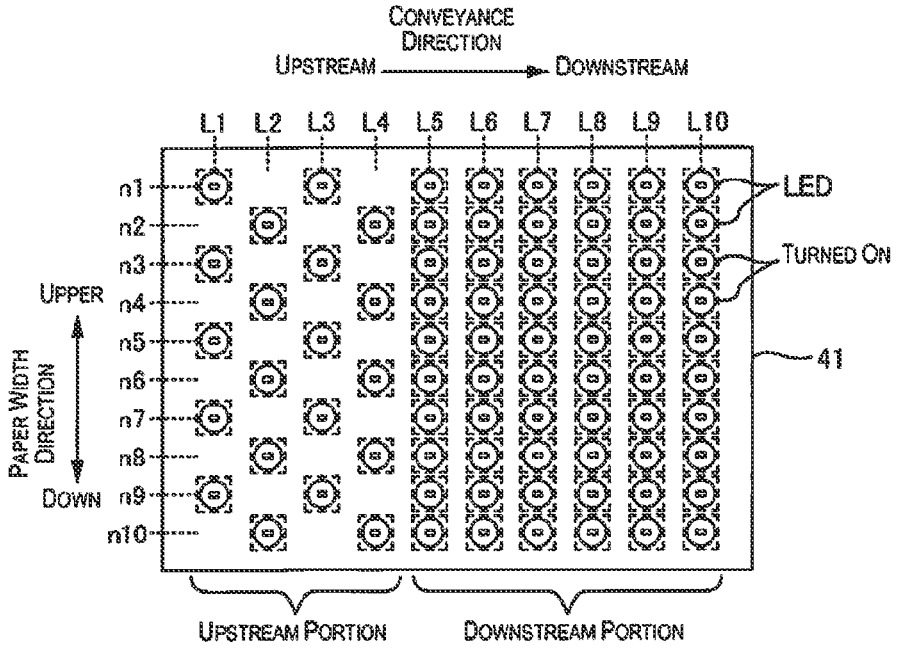
FIG. 9A and FIG. 9B are diagrams illustrating the LED irradiating section in the matte mode.
Figure 9B:
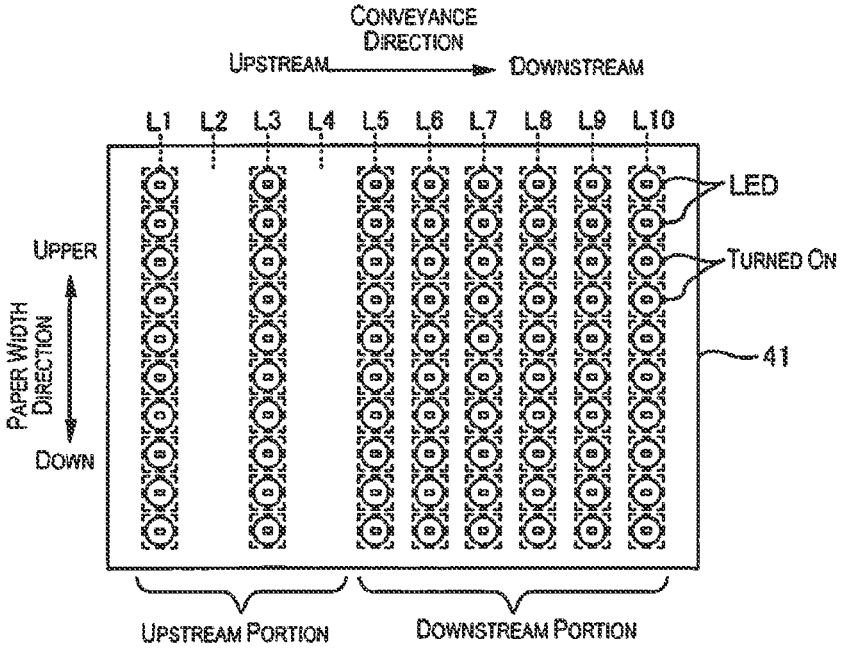

FIG. 9A and FIG. 9B are diagrams illustrating the LED irradiating section for the matte mode. In the application examples, the same LED irradiating sections 41 are adopted in the matte mode and the glossy mode. However, the invention is not limited to this configuration. One can also adopt a configuration in which the LED irradiating sections 41 for the matte mode and the LED irradiating sections 41 for the glossy image are arranged separately. In this case, there is no need to control the on/off function of the LEDs or to move the LED rows in the upstream portion of the LED irradiating sections 41 in the lateral direction and conveyance direction corresponding to the printing mode.

For example, when the number of the LEDs turned on for the unit area corresponding to the printing mode is changed, the LED irradiating sections 41 for the matte mode, as shown in FIG. 9A, can be used. In the upstream portion of the LED irradiating sections 41 shown in FIG. 9A, different from the downstream portion, the LEDs are thinned out for every other one as they are arranged. More specifically, in the upstream portion, the even-numbered LEDs (n2, n4, . . . ) belonging to the odd-numbered LED rows (L1, L3) are thinned out, and the odd-numbered LEDs (n1, n3, . . . ) belonging to the even-numbered LED rows (L2, L4) are thinned out.

Also, for example, when the interval between the LED rows in the conveyance direction is changed corresponding to the printing mode, the LED irradiating sections 41 for the matte mode as shown in FIG. 9B can be used. The LED rows in the upstream portion of the LED irradiating sections 41 shown in FIG. 9B are thinned as compared with the downstream portion. More specifically, in the upstream portion, the even-numbered LED rows (L2, L4) are thinned out.

For the LED irradiating sections 41 (FIG. 9A and FIG. 9B), the irradiation intensity Iu of the upstream portion can be lower than the irradiation intensity Il of the downstream portion. Consequently, in the matte mode, for the UV inks on the medium S, the light (UV light) with a lower energy can be irradiated from the start, and it is possible to print the matte image.

Modified Example 2 of Application Examples 1 to 4

In the application examples, in the matte mode, the irradiation intensity Iu of the upstream portion of the LED irradiating sections 41 is lower than the irradiation intensity Il of the downstream portion. However, the invention is not limited to this configuration. For example, one can also adopt a configuration in which, when two LED irradiating sections 41 are used to irradiate the UV light on the medium S, the time when the initial LED irradiating section 41 faces the medium S is shorter than the time when the second LED irradiating section 41 faces the medium S. That is, the relative moving speed between the initial LED irradiating section 41 and the medium S can be higher than the relative moving speed between the second LED irradiating section 41 and the medium S. In this case, after initial irradiation with the light with a lower energy, the light with a higher energy is irradiated on the UV inks on the medium S, so that the matte image is printed.

Application Example 5

Figure 11A:
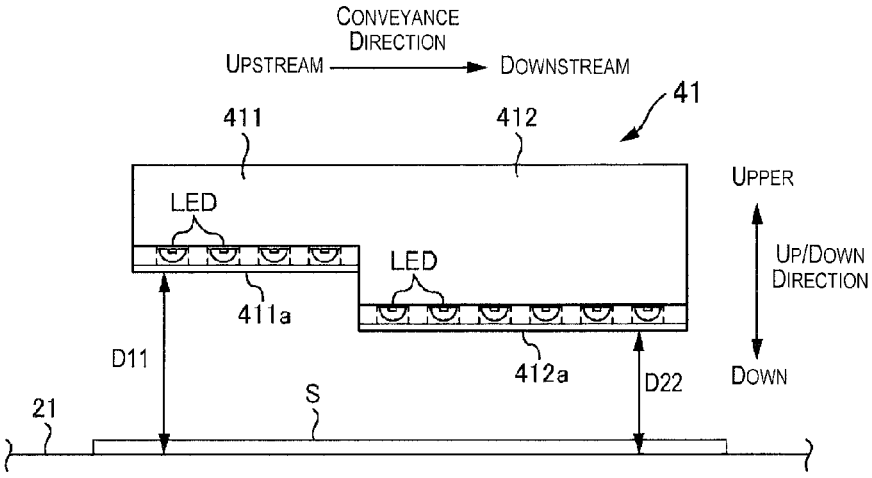
FIG. 11A and FIG. 11B are diagrams illustrating the LED irradiating section in Application Example 5.
Figure 11B:
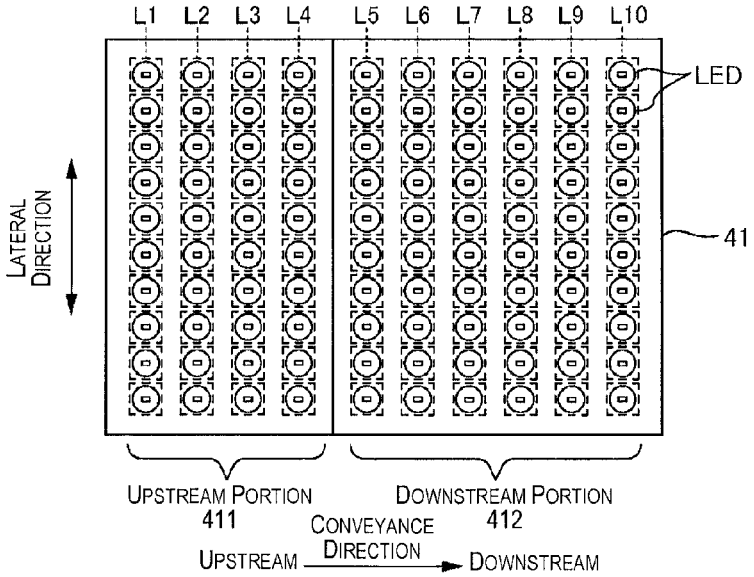
Figure 11C:
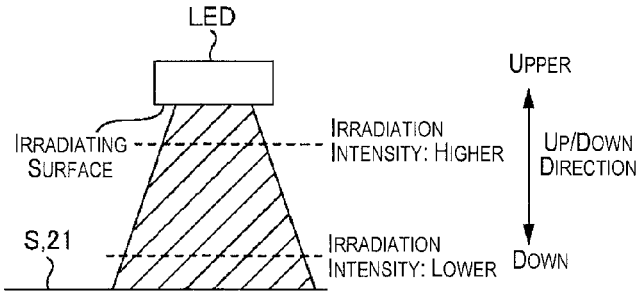
FIG. 11C is a diagram illustrating the relationship between the distance from the irradiated surface of the LED and the irradiation intensity.

FIG. 11A and FIG. 11B are diagrams illustrating the LED irradiating sections 41 in Application Example 5. FIG. 11C is a diagram illustrating the relationship between the distance between the LEDs, the irradiated surface and the irradiation intensity. FIG. 11A is a cross-sectional view illustrating the LED irradiating sections 41 taken across the lateral direction crossing the conveyance direction. FIG. 11B is a diagram illustrating the configuration of the LEDs on the lower surface of the LED irradiating sections 41. On the lower surface of the LED irradiating sections 41, 10 "LED rows" each including 10 LEDs in the lateral direction are formed side by side. These 10 LED rows (L1 to L10) are arranged side by side in the conveyance direction. In the following, in order to facilitate the explanation, the LED rows are numbered in the ascending order from the LED row on the upstream side (L1, L2, . . . ). Also, as shown in FIG. 10, the LED irradiating sections 41 shown in FIG. 11A and FIG. 11B are arranged on the downstream side from the heads 31 that eject the inks of various colors (KCMY), respectively.

In Application Example 5, for the LED irradiating sections 41, a step is arranged at the intermediate site in the conveyance direction, and the portion on the upstream side in the conveyance direction (hereinafter to be referred to as the upstream portion 411) is arranged farther from the medium S than the portion on the side downstream in the conveyance direction (hereinafter to be referred to as the downstream portion 412). That is, the distance D11 from the irradiating surface 411*a* of the upstream portion 411 to the supporting portion of the medium S (the conveyor belt 21) is longer than the distance D22 from the irradiating surface 412*a* of the downstream portion 412 to the supporting portion of the medium S (the conveyor belt 21) (D11>D22). In other words, the distance from the irradiating surface to the medium S (the supporting portion) in the upstream portion 411 is longer than that of the downstream portion 412. Here, the distance between the irradiating surface and the medium S (the supporting portion) is the length in the direction orthogonal to the irradiating surface and the medium S (the up/down direction shown in FIG. 11A). Also, the irradiating surface 411*a* of the upstream portion 411 and the irradiating surface 412*a* of the downstream portion 412 are parallel with the surface of the medium S (horizontal).

As shown in FIG. 11C, the intensity of the light (UV light) irradiated from the LEDs becomes lower as the distance from the irradiating surface of the LEDs becomes greater. Consequently, as for the LED irradiating section 41 in Application Example 5, the distance from the irradiating surface to the medium S for the upstream portion 411 is greater than that for the downstream portion 412. Also, the medium S conveyed on the conveyor belt 21 faces the upstream portion 411 before the medium S faces the downstream portion 412 of the LED irradiating section 41. That is, the UV light is irradiated on the UV inks on the medium S for the upstream portion 411 of the LED irradiating section 41 before the downstream portion 412.

Consequently, initially, the light (UV light) with a lower energy from the upstream portion 411 is irradiated on the UV inks on the medium S that passes beneath the LED irradiating section 41 in Application Example 5, and then, the light (UV light) with a higher energy is irradiated by the downstream portion 412. Consequently, for the image formed from the yellow and the black inks, initially, the outer layer portion of the image alone is cured, so that wrinkles are developed on the image surface as shown in FIG. 4, and it is possible to form the concavo-convex shape on the surface of the image.

That is, by irradiating the light (UV light) from the LED irradiating section 41 in Application Example 5, it is possible to form the concavo-convex shape on the surface of the overall image for the image formed from the yellow ink and the black ink, and it is possible to print the matte image with a lower glossiness. Also, because the clear ink is used, it is possible to print a matte image with a high scratch resistance.

As shown in FIG. 11A and FIG. 11B, the (number 4) of the LED rows (L1 to L4) belonging to the upstream portion 411 of the LED irradiating section 41 is smaller than the (number 6) of the LED rows (L5 to L10) belonging to the downstream portion 412. However, the invention is not limited to this configuration. One can also adopt a configuration in which the number of the LED rows belonging to the upstream portion 411 is larger than, or equal to, the number of the LED rows belonging to the downstream portion 412.

Application Example 6

Figure 12A:
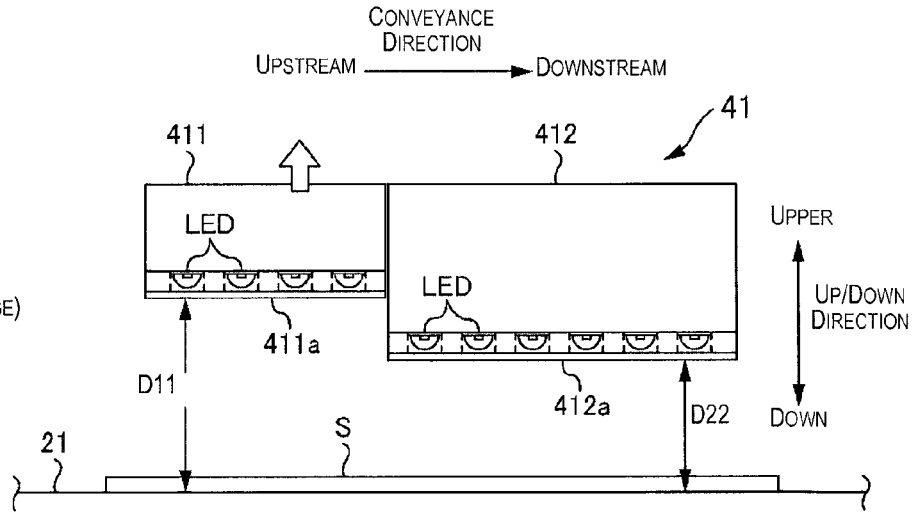
FIG. 12A is a diagram illustrating the LED irradiating section in the matte mode.
Figure 12B:
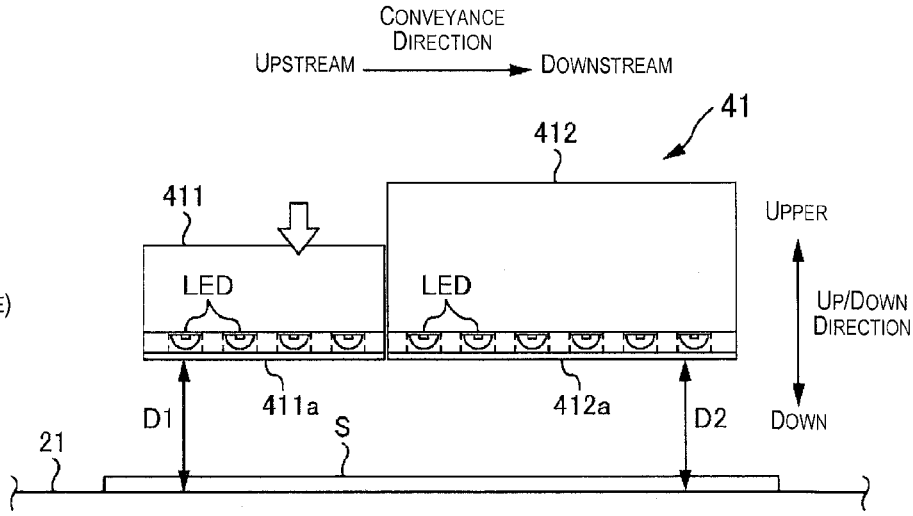
FIG. 12B is a diagram illustrating the LED irradiating section in the glossy mode.

FIG. 12A is a diagram illustrating the LED irradiating section 41 in the matte mode. FIG. 12B is a diagram illustrating the LED irradiating section 41 in the glossy mode. According to Application Example 6, the printer 1 prints 2 types of images with different degrees of glossiness corresponding to the application of the user. Consequently, the printer 1 has the "matte mode" and the "glossy mode." When the matte mode is set, the printer 1 prints the matte image with a significant embossing on the image surface and with a lower glossiness.

On the other hand, when the glossy image is set, the printer 1 prints the glossy image with a smooth image surface and with a glossiness higher than that printed in the matte mode.

As explained above with reference to FIG. 4 and Application Example 5, after the light (UV light) with a lower energy is initially irradiated on the UV inks on the medium S, the light with a higher energy is irradiated, so that wrinkles are formed on the image surface, the image surface can be formed in concavo-convex shape, and it is possible to print a matte image. Consequently, on the contrary, when the glossy image is set, for the UV inks on the medium S, when the light with a lower energy is initially irradiated and then the light with a higher energy is irradiated, the image surface takes on the concavo-convex shape, and it is impossible to print the global image with a higher glossiness.

Here, for the printer 1, when the matte mode is set, for the UV inks on the medium S, after the UV light with a lower energy is irradiated initially, the UV light with a higher energy is irradiated. When the glossy image is set, for the UV inks on the medium S, the UV light with the higher energy is initially irradiated. That is, the UV light with an energy higher than the initial energy is irradiated in the matte mode.

For this purpose, for the LED irradiating section 41 adopted in Application Example 6, the structure of the upstream portion 411 is such that the structure can move in the up/down direction (in the direction perpendicular to the irradiating surface, usually, in the orthogonal direction). Here, in order to facilitate the explanation, in FIG. 12, the moving mechanism of the upstream portion 411 is not shown. In addition, here, the controller 10 in the printer 1 adjusts the up/down position of the upstream portion 411.

When the matte mode (corresponding to the first mode) is set (FIG. 12A), the controller 10 issues a control so that the upstream portion 411 is driven to move to the upper side in the up/down direction; thus, the distance D11 from the irradiating surface 411*a* of the upstream portion 411 to the supporting portion of the medium S (conveyor belt 21) is greater than the distance D22 from the irradiating surface 412*a* of the downstream portion 412 to the supporting portion of the medium S (D11>D22).

On the other hand, when the glossy image (corresponding to the second mode) is set (FIG. 12B), the controller 10 issues a control so that the upstream portion 411 is driven to move to the lower side in the up/down direction; thus, the distance D11 from the irradiating surface 411*a* of the upstream portion 411 to the supporting portion of the medium S (conveyor belt 21) becomes equal to the distance D22 from the irradiating surface 412*a* of the downstream portion 412 to the supporting portion of the medium S (D11=D22).

As a result, in the matte mode, for the LED irradiating sections 41, the distance from the irradiating surface to the medium S for the upstream portion 411 is longer than that for the downstream portion 412, and the irradiation intensity of the light irradiated by the upstream portion 411 on the UV inks on the medium S is lower than the irradiation intensity of the light irradiated by the downstream portion 412 on the UV inks on the medium S. Consequently, for the UV inks on the medium S, initially, they are irradiated by the light (UV light) with a lower energy from the upstream portion 411, and then they can be irradiated by the light with a higher energy from the downstream portion 412.

Consequently, for the image formed from the yellow and the black inks, initially, only the outer layer portion of the image is cured, so that the wrinkles are developed on the surface of the image and so that the image surface can take on the concavo-convex shape. As a result, even in this case when an image is printed with a higher ink duty, for the image using the yellow ink and the black ink, the surface of the entirety of the image can take on the concavo-convex shape, and it is possible to print a matte image with a lower glossiness. Here, as no clear ink is in use, it is possible to print a matte image with a high scratch resistance.

In addition, in the matte mode, when an image is printed with a lower ink duty, even when no UV light with a lower energy is irradiated initially, that is, even when the UV light with a higher energy is irradiated from the start, as shown in FIG. 3A, it is still possible print a matte image. However, in this case when the matte mode is set, here, the upstream portion 411 can be driven to move to the upper side irrelevant to the ink duty. As a result, the controller 10 can carry out control easily.

On the other hand, in the glossy image, for the LED irradiating sections 41, the distance from the irradiating surface to the medium S of the upstream portion 411 is the same as that of the downstream portion 412, and the irradiation intensity of the light irradiated on the UV inks on the medium S from the upstream portion 411 is as high as that of the irradiation intensity of the light irradiated on the UV inks from the downstream portion 412. In addition, the distance from the irradiating surface to the medium S for the upstream portion 411 in the glossy image is shorter than that for the upstream portion 411 in the matte mode, so that the irradiating surface of the upstream portion in the glossy image is also higher than that of the upstream portion in the matte mode. Consequently, for the UV inks on the medium S, they can be irradiated by the light with a higher energy initially from the upstream portion 411 and then by the light also with a higher energy from the downstream portion 412.

As a result, the entire image can be cured at a single stretch, and the image can be cured with a smooth surface. Consequently, when an image is printed with a high ink duty, as shown in FIG. 3B, it is possible to print a glossy image with a smooth image surface and a high glossiness. In addition, when an image with a low ink duty (FIG. 3A) is printed, by ejecting a clear ink on the image, it is possible to print the glossy image with a smooth surface on the image.

As explained above, by adjusting the position of the upstream portion 411 of the LED irradiating sections 41 in the up/down direction corresponding to the printing mode and adjusting the distance from the irradiating surface 411*a* of the upstream portion 411 to the medium S (supporting portion), it is possible to print the image with a glossiness corresponding to the printing mode.

In addition, here, the same LED irradiating sections 41 are adopted for both the matte mode and the glossy mode. Consequently, the upstream portion 411 can be driven to move in the up/down direction. However, the invention is not limited to this configuration. For example, one can also adopt a configuration in which, as the LED irradiating section 41 for the matte mode with a greater distance from the irradiating surface 411*a* of the upstream portion 411 to the medium S, as shown in FIG. 12A, an LED irradiating section 41 for the glossy image and with a shorter distance from the irradiating surface 411*a* of the upstream portion 411 to the medium S, as shown in FIG. 12B, is arranged separately.

Application Example 7

As explained above, to ensure curing of the UV inks by the light from the LED irradiating section 41, an LED irradiating section 41 that irradiates the light at the wavelength absorbed by the photopolymerization initiator in the UV inks is adopted. Consequently, the peak wavelength of the LED irradiating section 41 is contained in the wavelength region of the light absorbed by the photopolymerization initiator.

In addition, as compared with the coloring agents of the yellow and the black inks, it is harder for the coloring agents of the magenta and the cyan inks to absorb the light at the wavelength contributing to curing of the UV inks, that is, the light at the wavelength absorbed by the photopolymerization initiator. Consequently, even when the image formed from the magenta and the cyan inks is initially irradiated by the light with a lower energy, the light still can reach the photopolymerization initiator inside of the image, so that the interior of the image still can be cured. As a result, for the image formed from the magenta and the cyan inks, the wrinkles can hardly form on the image surface, and it is hard to form a matte image.

Here, according to Application Example 7, the UV inks contain an assisting agent that absorbs the light at the peak wavelength emitted from the LED irradiating section 41. As a result, when the image formed from the cyan and the magenta inks is irradiated by the light, the assisting agent absorbs the light at the wavelength absorbed by the photopolymerization initiator, so that the transmissivity of the light degrades. Consequently, when a matte image is to be printed, the light with a lower energy is initially irradiated, so that the light can hardly reach the photopolymerization initiator inside of the image formed from the cyan and the magenta inks, and it is possible to cure only the outer layer portion without curing the interior of the image. As a result, wrinkles are developed on the image surface, it is possible to form a concavo-convex shape on the image surface, and it is possible to print the matte image.

According to Application Example 7 as explained above, it is possible to form the concavo-convex shape for the image surface not only for the image formed from the yellow and the black inks but also for the image formed from the cyan and the magenta inks. Consequently, for these images, the concavo-convex surface of the entire image can be made more significant, and it is possible to print the matte image with a higher reliability. Also, even when the yellow and the black inks are not in use, it is still possible to print the matte image. The assisting agent can also be contained only in one of the UV inks, either cyan or magenta.

Examples of the assisting agents that can absorb the peak wavelength (395 nm) of the LED irradiating sections 41 include 1-(phenyl)ethanone, di(4-methoxy phenyl)diketone, 1,2-bis(phenyl)ethane dione, α-hydroxy-α-phenyl acetophenone, 1,2-diphenyl-2-ethoxy ethanone, 1,2-diphenyl-2-

(isobutoxy)ethanone, 1,2-diphenyl-2-(isopropyloxy)ethane-1-one, 1-[(diphenyl phosphinyl)carbonyl]-2,4,6-trimethyl benzene, and 2-(methoxy carbonyl)benzophenone.

Modified Example of Application Examples 5 to 7

Figure 13:
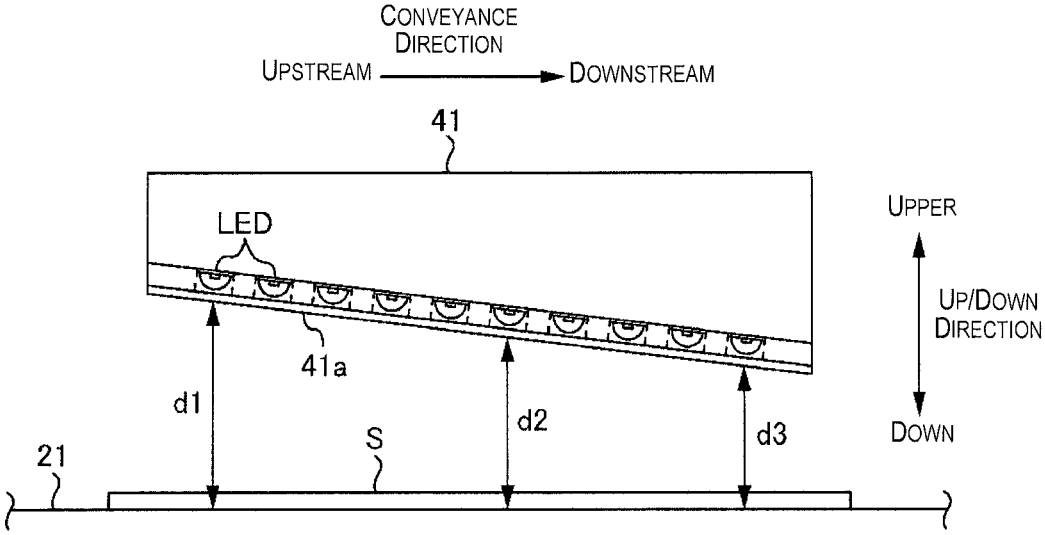
FIG. 13 is a diagram illustrating a modified example of the LED irradiating section.

FIG. 13 is a diagram illustrating a modified example of the LED irradiating sections 41. In the LED irradiating sections 41 in the application examples (FIG. 11A), a step is arranged at the intermediate position in the conveyance direction, and the irradiating surface 411*a* of the upstream portion 411 and the irradiating surface 412*a* of the downstream portion 412 are parallel with the surface of the medium S. However, the invention is not limited to this configuration. For example, one can also adopt a configuration in which the irradiating surface 41*a* of the LED irradiating section 41, as shown in FIG. 13, is inclined in the conveyance direction. More specifically, for the irradiating surface 41*a*, in order to have the downstream portion in the conveyance direction be located lower in the up/down direction than in the upstream portion, the irradiating surface 41*a* is formed to incline. As a result, the distance from the irradiating surface 41*a* to the medium S (conveyor belt 21) gradually becomes smaller as the position moves from the upstream side to the downstream side in the conveyance direction (d1>d2>d3).

For such an LED irradiating section 41, the irradiation intensity of the upstream portion in the conveyance direction can be made lower than the irradiation intensity of the downstream portion. Consequently, it is possible to irradiate the UV inks on the medium S with a light with a higher energy after irradiation initially with a light (UV light) with a lower energy, so that it is possible to print a matte image.

In the application examples, only one step is arranged for the LED irradiating section 41 (FIG. 11A), and the distance from the irradiating surface to the medium S (conveyor belt 21) is changed only once. However, the invention is not limited to this configuration. For example, one can also adopt a configuration in which 2 or more steps are arranged for the LED irradiating section 41, so that the distance from the irradiating surface to the medium S is changed in plural rounds.

Also, one can adopt a printer 1 that carries the LED irradiating section 41 on a carriage (not shown in the figure) that can drive the head to move to one side in the moving direction with respect to the medium. In this case, the LED irradiating section 41 is arranged on the other side in the moving direction with respect to the head. Here, the distance from the irradiating surface of the LED irradiating section on one side in the moving direction to the medium is longer than the distance from the irradiating surface of the portion on the other side to the medium. In this case, too, for the UV inks ejected from the heads moving in the moving direction, after initial irradiation by the light with a lower energy, they are then irradiated by the light with a higher energy, so that it is possible to print the matte image.

Other Embodiments

In the embodiment, as the medium passes beneath the heads anchored and extending over the width and length of the medium, inks are ejected from the heads to the medium, so that the printer can print the two-dimensional image on the medium. However, the invention is not limited to this configuration. For example, one can also adopt a printer, wherein the operation in which inks are ejected onto the medium as the heads are driven to move in the moving direction, and the operation, wherein the medium is conveyed downward in the conveyance direction with regard to the heads, are carried out alternately; additionally, the photo-curable inks on the medium are cured by the LED irradiating section arranged on the downstream side from the heads in the conveyance direction.

What is claimed is:

1. A printing apparatus, comprising:

a head unit that ejects a yellow UV curable-type ink onto a medium;

an irradiating section that irradiates the UV light; and a controller that works such that when the first mode is set, control is carried out so that after the UV light with the first energy is irradiated on the UV curable-type ink ejected onto each unit area of the medium, the UV light with the second energy higher than the first energy is irradiated, and such that when the second mode is set for printing an image with a glossiness higher than that of the image printed according to the first mode, control is carried out so that the UV light with an energy higher than that of the first energy is irradiated on the UV curable-type ink ejected on the unit area of the medium;

a conveyor that supports the medium at the position facing the head unit and conveys the medium to the downstream side in the conveyance direction, wherein the irradiation section has an upstream portion located on the upstream side in the conveyance direction and a downstream portion located on the downstream side in the conveyance direction; the upstream portion can be moved in the direction crossing the irradiated surface of the upstream portion, when the first mode is set, the first distance from the irradiated surface to the supporting section of the medium in the downstream portion in the conveyance direction is longer than the second distance from the downstream portion in the conveyance direction to the supporting section of the medium, and when the second mode is set, the first distance is shorter than the second distance.

2. A printing apparatus comprising:

a first head unit that ejects a yellow UV curable-type ink onto a medium;

an irradiating section that irradiates a UV light; and a controller that controls the irradiating section such that when a first mode is set, after the UV light with a first energy is irradiated on the UV curable-type ink ejected onto each unit area of the medium, the UV light with a second energy higher than the first energy is irradiated, and such that, when a second mode is set for printing an image with a glossiness higher than that of the image printed according to the first mode, the UV light with an energy higher than that of the first energy is irradiated on the UV curable-type ink ejected on the unit area of the medium, the medium being conveyed to a downstream side with respect to the irradiating section with respect to a conveyance direction, the irradiation section including a first unit and a second unit disposed downstream relative to the first unit, during the first mode, the UV light with the first energy being irradiated by the first unit, and the UV light with the second energy being irradiated by the second unit, the first unit including a first LED row and a second LED row, the second unit including at least a third LED row, each of the first, the second, the third LED rows having a plurality of LEDs that are aligned along a crossing direction perpendicular to the conveyance direction, and the first LED row being disposed movably in the crossing direction relative to the second LED row and the third LED row on the irradiation unit.

3. A printing apparatus comprising:

a first head unit that ejects a yellow UV curable-type ink onto a medium;

an irradiating section that irradiates a UV light; and a controller that controls the irradiating section such that when a first mode is set, after the UV light with a first energy is irradiated on the UV curable-type ink ejected onto each unit area of the medium, the UV light with a second energy higher than the first energy is irradiated, and such that, when a second mode is set for printing an image with a glossiness higher than that of the image printed according to the first mode, the UV light with an energy higher than that of the first energy is irradiated on the UV curable-type ink ejected on the unit area of the medium, the medium being conveyed to a downstream side with respect to the irradiating section with respect to a conveyance direction, the irradiation section including a first unit and a second unit disposed downstream relative to the first unit, during the first mode, the UV light with the first energy being irradiated by the first unit, and the UV light with the second energy being irradiated by the second unit, the first unit including a first LED row and a second LED row, the second unit including at least a third LED row, each of the first, the second, the third LED rows having a plurality of LEDs that are aligned along a crossing direction perpendicular to the conveyance direction, and the first LED row and the second LED row being disposed movably in the conveyance direction relative to the third LED row on the irradiation unit.

* * * * *